US011646004B2

(12) United States Patent
Spinelli

(10) Patent No.: US 11,646,004 B2
(45) Date of Patent: May 9, 2023

(54) SNARE DRUM THROW OFF

(71) Applicant: John Spinelli, Pinellas Park, FL (US)

(72) Inventor: John Spinelli, Pinellas Park, FL (US)

( * ) Notice: Subject to any disclaimer, the term of this patent is extended or adjusted under 35 U.S.C. 154(b) by 262 days.

(21) Appl. No.: 17/202,987

(22) Filed: Mar. 16, 2021

(65) Prior Publication Data

US 2021/0287637 A1 Sep. 16, 2021

Related U.S. Application Data

(60) Provisional application No. 62/990,050, filed on Mar. 16, 2020.

(51) Int. Cl.
*G10D 13/18* (2020.01)
*G10D 13/02* (2020.01)

(52) U.S. Cl.
CPC ..... *G10D 13/18* (2020.02); *G10D 13/02* (2013.01)

(58) Field of Classification Search
CPC ..... G10D 13/18; G10D 13/02
See application file for complete search history.

(56) References Cited

U.S. PATENT DOCUMENTS

| | | | | |
|---|---|---|---|---|
| 4,787,286 | A * | 11/1988 | Okumura | G10D 13/02 984/151 |
| 6,846,978 | B2 * | 1/2005 | Dorfman | G10D 13/02 84/411 R |
| 2005/0188818 | A1 * | 9/2005 | Okamoto | G10D 13/02 84/415 |
| 2005/0204895 | A1 * | 9/2005 | Yu-Hwa | G10D 13/18 84/415 |
| 2009/0133564 | A1 * | 5/2009 | Miyajima | G10D 13/02 84/415 |
| 2010/0242707 | A1 * | 9/2010 | Miyajima | G10D 13/18 84/415 |
| 2011/0120286 | A1 * | 5/2011 | Good | G10D 13/02 84/415 |

* cited by examiner

*Primary Examiner* — Jianchun Qin
(74) *Attorney, Agent, or Firm* — Lewellyn Law, PLLC; Stephen Lewellyn

(57) ABSTRACT

A snare drum throw off has handle that is rotatable between a positive engaged position and a positive disengaged position for engaging and disengaging a snare of a snare drum. The tension on the snare when in the positive engaged position is adjustable by a tensioner.

6 Claims, 5 Drawing Sheets

FIG. 5
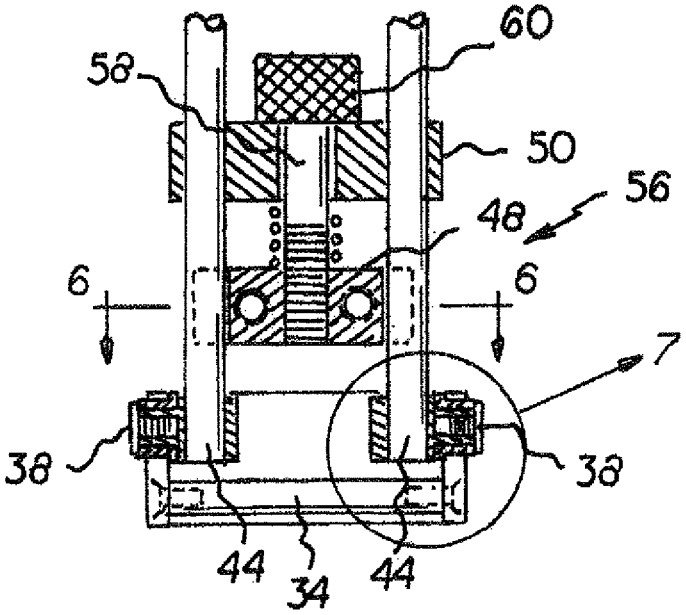
FIG. 6
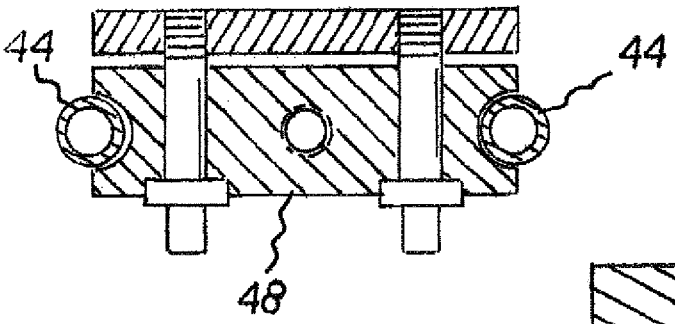
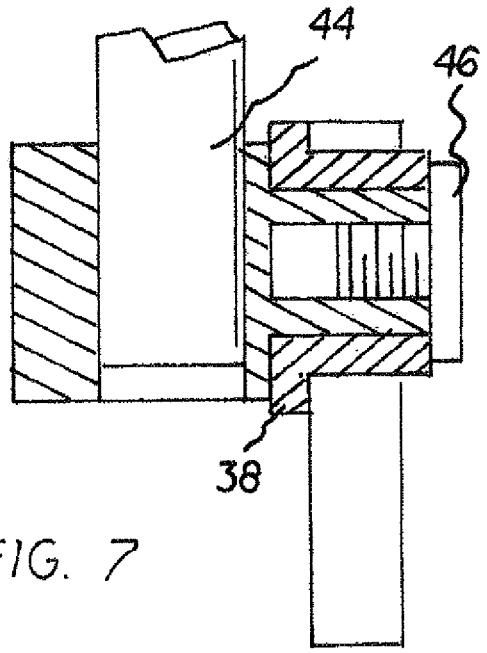
FIG. 7

SNARE DRUM THROW OFF

CROSS-REFERENCE TO RELATED APPLICATIONS

This application claims the benefit of U.S. Provisional Patent Application Ser. No. 62/990,050, filed Mar. 16, 2020, the entirety of which is incorporated herein by reference.

FIELD OF THE INVENTION

The present invention relates to a snare drum throw off system, and more particularly, pertains to supporting a throw off component within a drum, for activating/inactivating the throw off component, and for adjustably tensioning the throw off component and its tone.

BACKGROUND OF THE INVENTION

The use of drum accessories is known in the prior art. More specifically, drum accessories previously devised and utilized for the purpose of creating drum music are known to consist basically of familiar, expected, and obvious structural configurations, notwithstanding the myriad of designs encompassed by the crowded prior art which has been developed for the fulfillment of countless objectives and requirements.

While these devices fulfill their respective, particular objectives and requirements, do not describe a snare drum throw off system that allows supporting a throw off component within a drum, for activating/inactivating the throw off component, and for adjustably tensioning the throw off component and its tone.

In this respect, the snare drum throw off system according to the present invention substantially departs from the conventional concepts and designs of the prior art, and in doing so provides an apparatus primarily developed for the purpose of supporting a throw off component within a drum, for activating/inactivating the throw off component, and for adjustably tensioning the throw off component and its tone.

Therefore, it can be appreciated that there exists a continuing need for a new and improved snare drum throw off system which can be used for supporting a throw off component within a drum, for activating/inactivating the throw off component, and for adjustably tensioning the throw off component and its tone. In this regard, the present invention substantially fulfills this need.

SUMMARY OF THE INVENTION

In view of the disadvantages inherent in the known types of drum accessories now present in the prior art, the present invention provides an improved snare drum throw off system. As such, the general purpose of the present invention, which will be described subsequently in greater detail, is to provide a new and improved snare drum throw off system and method which has all the advantages of the prior art and none of the disadvantages.

In this respect, before explaining at least one embodiment of the invention in detail, it is to be understood that the invention is not limited in its application to the details of construction and to the arrangements of the components set forth in the following description or illustrated in the drawings.

In general, in one aspect a snare drum throw off is provided. The throw off includes a pivot block pivotally attachable to a side wall of a drum for rotation about a first axis between an engaged position and a disengaged position. The pivot block has an upper extent that is configured for attachment to a snare. A minor cylinder has opposed first and second ends, a first longitudinal bore extending entirely through the minor cylinder between the first and second ends thereof, and a first cam surface. A major cylinder has opposed first and second ends, a second longitudinal bore extending entirely through the major cylinder between the first and second ends thereof, and a second cam surface.

A length of the major cylinder is disposed within the first longitudinal bore with the first and second cam surfaces in contact with each other, and such that the major cylinder is rotatable about a second axis between a first rotation position and a second rotation position and such that major cylinder slidable back-and-forth along the second axis between a first slide position and a second slide position.

In the first rotation position the contact between the first and second cam surfaces positions the major cylinder in the first slide position, and in the second rotation position the contact between the first and second cam surfaces positions the major cylinder in the second slide position.

A tension bolt has first and second ends, the tension bolt extends through the second axial bore with the first end thereof threadedly attached to the pivot block, the second end of the tension bolt has a head engaged against the second end of the major cylinder. A spring is held captive between the pivot block and the minor cylinder and biases the pivot block in a direction away from the minor cylinder and into the disengaged position.

When the major cylinder is disposed in the first slide position, the pivot block is disposed in the disengaged position, and when the major cylinder is disposed in the second slide position, the pivot block is disposed in the engaged position. In the disengaged position, an attached snare is disengaged from contact with the drumhead. And in the engaged position, the snare is engaged in contact with the drumhead.

The invention is capable of other embodiments and of being practiced and carried out in various ways. Also, it is to be understood that the phraseology and terminology employed herein are for the purpose of descriptions and should not be regarding as limiting.

There has thus been outlined, rather broadly, the more important features of the invention in order that the detailed description thereof that follows may be better understood and in order that the present contribution to the art may be better appreciated.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods, and systems for carrying out the several purposes of the present invention. It is important, therefore, that the claims be regarded as including such equivalent constructions insofar as they do not depart from the spirit and scope of the present invention.

For a better understanding of the invention, its operating advantages and the specific objects attained by its uses, reference should be had to the accompanying drawings and descriptive matter in which there are illustrated embodiments of the invention.

BRIEF DESCRIPTION OF THE DRAWINGS

The following drawings illustrate by way of example and are included to provide further understanding of the invention for the purpose of illustrative discussion of the embodiments of the invention. No attempt is made to show structural details of the embodiments in more detail than is necessary for a fundamental understanding of the invention, the description taken with the drawings making apparent to those skilled in the art how the several forms of the invention may be embodied in practice. Identical reference numerals do not necessarily indicate an identical structure. Rather, the same reference numeral may be used to indicate a similar feature of a feature with similar functionality. In the drawings:

FIG. 5 is a cross sectional view taken along line 5-5 of FIG. 2;

FIG. 6 is a cross sectional view taken along line 6-6 of FIG. 5;

FIG. 7 is a cross sectional view taken circle 7 of FIG. 5;

DETAILED DESCRIPTION OF THE INVENTION

Figure 1:
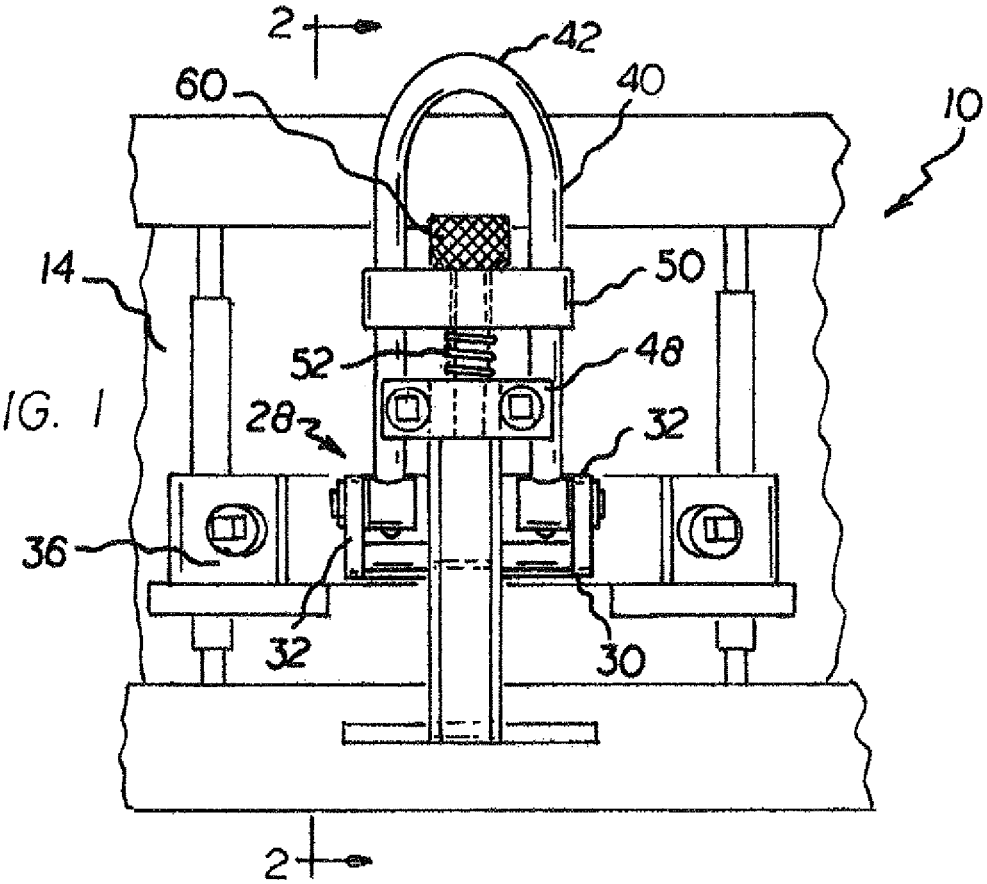
FIG. 1 is a front elevational view of a snare drum throw off system constructed in accordance with the principles of the present invention.
Figure 2:
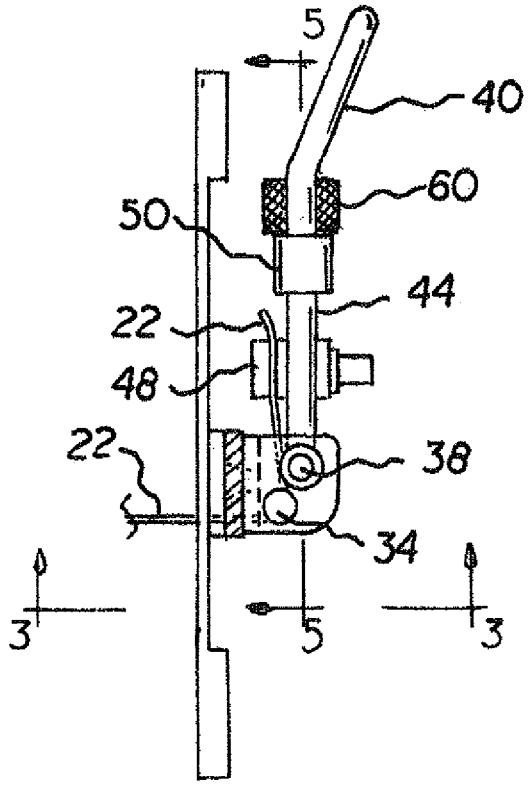
FIG. 2 is a cross sectional view taken along line 2-2 of FIG. 1.
Figure 3:
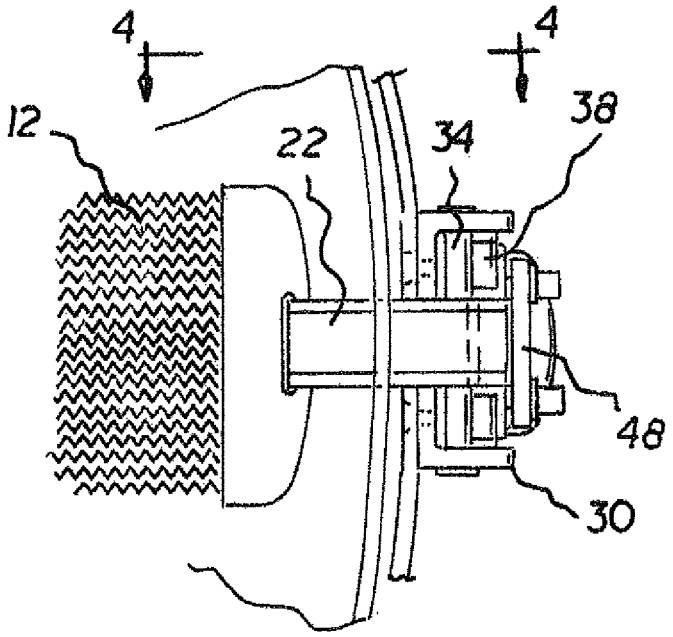
FIG. 3 is a cross sectional view taken along line 3-3 of FIG. 2.
Figure 4:
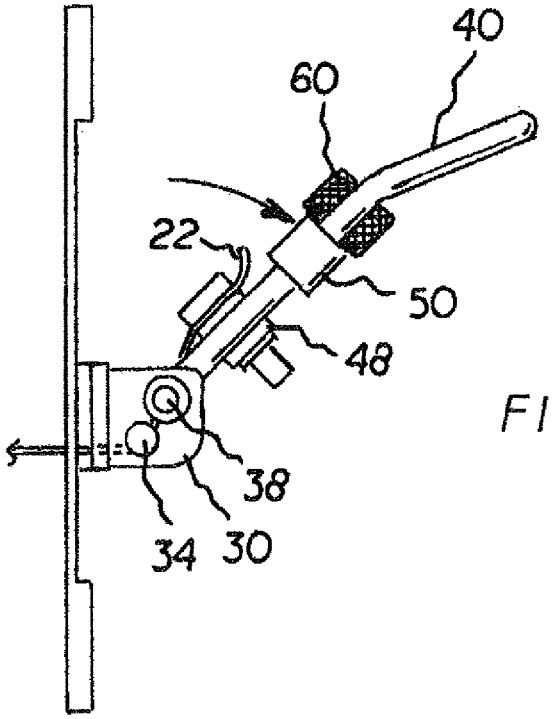
FIG. 4 is a side elevational view taken along line 4-4 of FIG. 3.

With reference now to the drawings, and in particular to FIGS. 1-7 thereof, the preferred embodiment of the new and improved snare drum throw off system embodying the principles and concepts of the present invention and generally designated by the reference numeral 10 will be described.

The present invention, the snare drum throw off system is comprised of a plurality of components. Such components are individually configured and correlated with respect to each other to attain the desired objective. In their broadest context, such invention is a system for use with a snare drum having a throw off component with a fixed end and a repositionable end.

An activating/inactivating assembly is coupled adjacent to a side wall of the drum adjacent to the repositionable end of the throw off component. The activating/inactivating includes a handle operatively coupled to the throw off component. Rotating the handle in a first direction will tighten the throw off component to an operative orientation. Rotating the handle in a second direction will loosen the throw off component to an inoperative orientation.

An adjustable tensioning assembly includes a tensioning bolt having a head and a threaded end coupled with respect to the throw off component. Rotating the knurled head in a first direction will adjustably tighten the throw off component. Rotating the knurled head in a second direction will adjustably loosen the throw off component.

The preferred embodiment of the present invention is illustrated in FIGS. 1-7. From a specific point of viewpoint, the present invention is a snare drum throw off system 10 for supporting and engaging and disengaging a snare 12 of a drum 14, for activating/inactivating the throw off component tensioning the throw off component and its tone.

The supporting and the activating/inactivating and the adjustably tensioning being done in a safe, convenient, and economical manner. The system includes the drum 14 having a top and a bottom with a cylindrical side wall 18 there between and a chamber there within.

Next provided is the snare 12. Such component has a fixed end positioned within the chamber with a strap 22 extending to exterior of the chamber and a central extent diametrically positioned within the chamber. The activation/inactivating assembly 28 is coupled to the side wall of the drum adjacent to the repositionable end of the throw off component. The activation/inactivating assembly includes a mounting bracket 30 having opposed facing walls 32 with a fixed guidepost 34 between the facing walls. Attachment members 36 couple the mounting bracket to the drum. Two pivot posts 38 are parallel with but spaced above the guidepost.

The activating/inactivating assembly includes a handle 40 formed with a central section 42 in an inverted U-shaped configuration and with two parallel linear sections 44 terminating in free ends. The free ends attached to the pivot posts by bolts. A strip clamp 48 and an adjustment pull 50 are secured to the linear section. A coil spring 52 urges separation between the strap and the adjustment. The strap is wrapped around the guidepost and attached to the strap clamp. Rotating the handle in a first direction will tighten the throw off component to an operative orientation. Rotating the handle in a second direction will loosen the throw off component to an inoperative orientation.

Lastly provided tensioning assembly 56 which includes a tensioning bolt 58 having a knurled head 60 and a threaded end 62. The tensioning bolt extends through the adjustment guide and is threadedly coupled to the pull strap. Rotating the knurled head in a first direction will adjustably tighten the throw off component and its tone. Rotating the knurled head in a second direction will adjustably loosen the throw off component and its tone.

Figure 8:
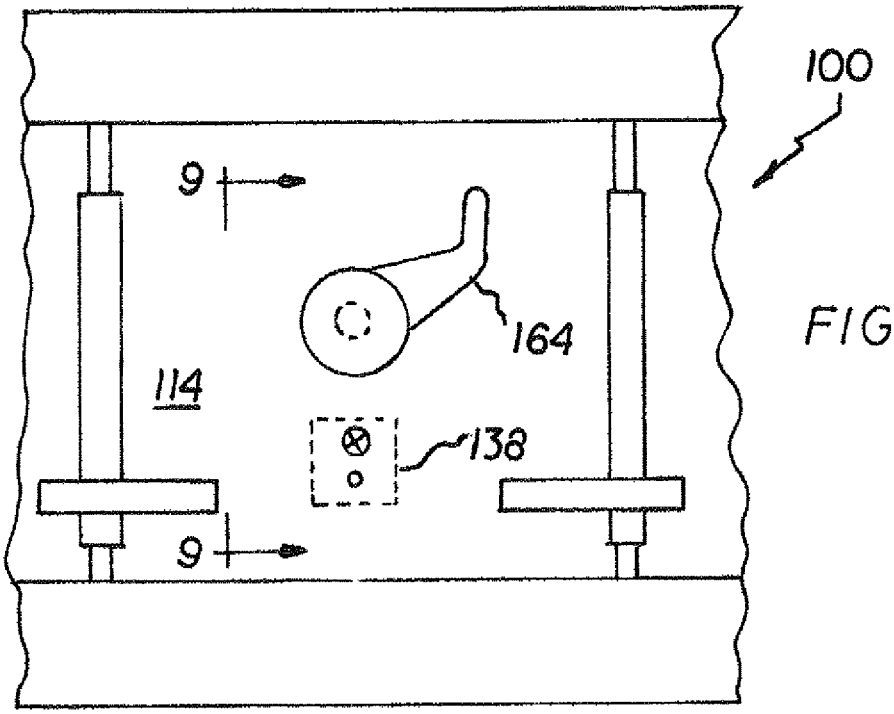
FIG. 8 is a front elevational view of a snare drum throw off system constructed in accordance with an alternate embodiment of the present invention.
Figures 9, 10:
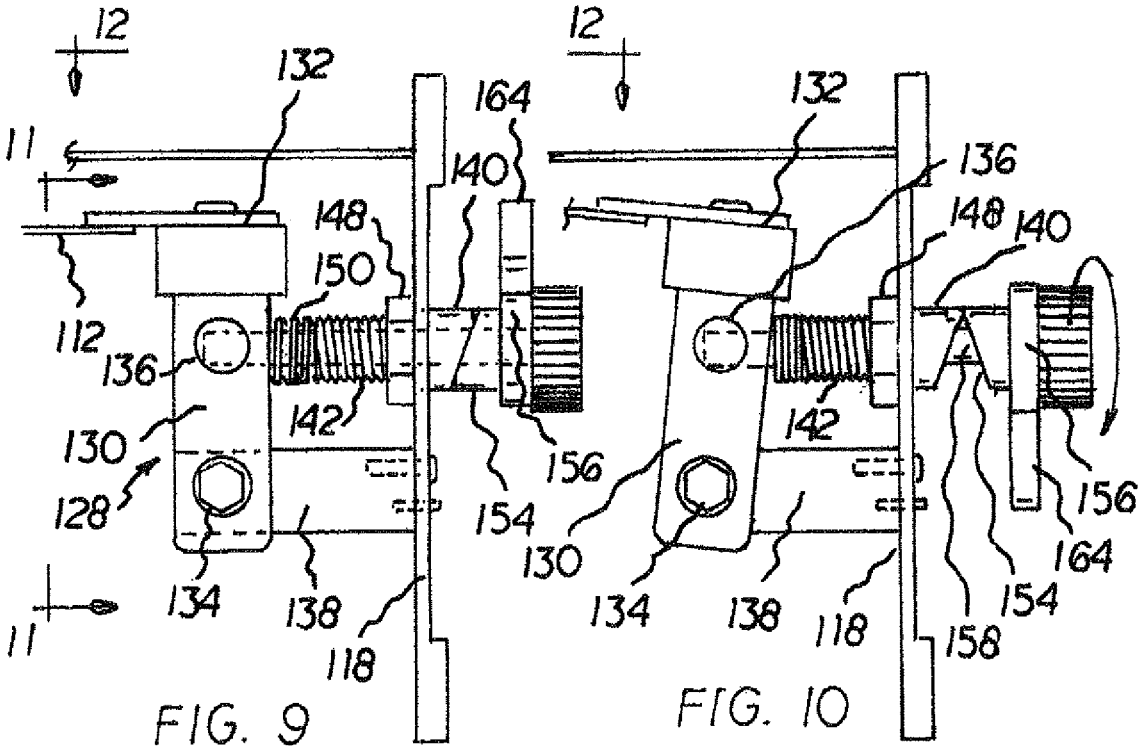
FIG. 9 is a side elevational view taken along line 9-9 of FIG. 8 with the throw off component in an inoperative orientation.
FIG. 10 is a side elevational view taken along line 9-9 of FIG. 8 with the throw off component in an operative orientation.
Figure 11:
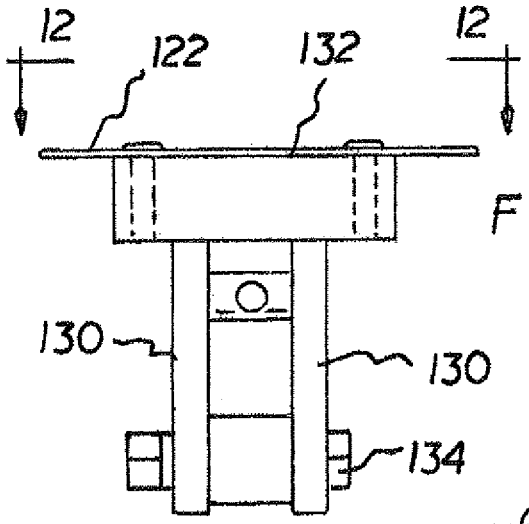
FIG. 11 is an end elevational view taken at line 11-11 of FIG. 9.
Figure 12:
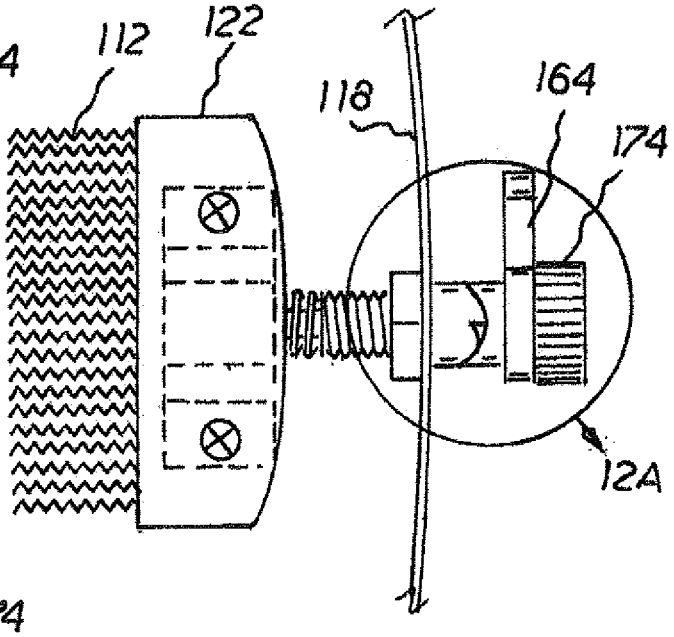
FIG. 12 is a plan view taken at line 12-12 of FIG. 9 with the throw off component in an inoperative orientation.
Figure 12A:
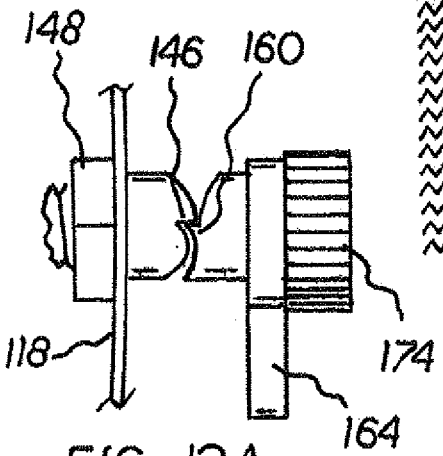
FIG. 12A is an enlarged showing taken at circle 12A of FIG. 12 with the throw off component in an operative orientation.
Figure 13:
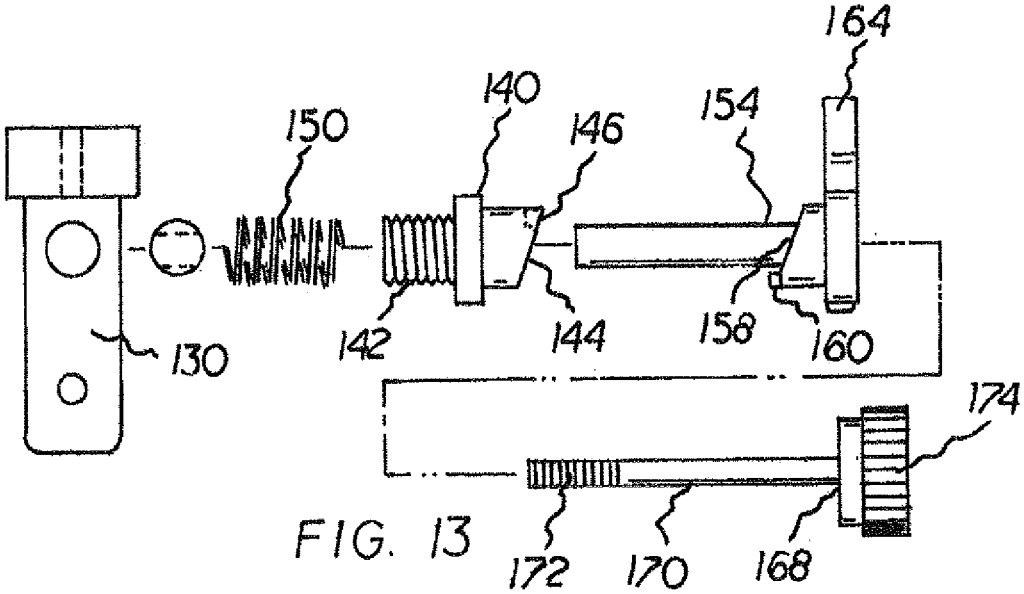
FIG. 13 is an exploded view of the adjustment assembly of the FIG. 12.

An alternate embodiment of the present invention is illustrated in FIGS. 8-13. From a specific point of viewpoint, the invention is a snare drum throw off system 100 for engaging and disengaging a snare 112 of drum 114, for activating/inactivating a drum snare, and for adjustable tensioning the snare and the related tone of the drum. The supporting and the activating/inactivating and the adjustably tensioning are done in a safe, convenient, and economical manner, the system includes the drum 114 having a top and a bottom with a cylindrical side wall 118 there between and a chamber therewithin.

Provided next is snare 112 having a fixed end positioned within the chamber and a repositionable end with 122 positioned within the chamber. Next, an activating/inactivating 128 assembly is coupled to the side wall of the drum adjacent to the repositionable end of the snare. The activating/inactivating assembly 128 includes a pivot block 130. The pivot block has an upper extent 132 attached to the end support and a lower extent 134 with an axis of rotation and a central extent 136. Fixed blades 138 are with the chamber attached to the side wall and pivotably supporting the lower end of the pivot block.

The activating/inactivating assembly 128 includes a minor cylinder 140 with a threaded interior end 142 within the chamber and a cam surface 144 with a recess 146 exterior of the chamber. A nut 148 is on the threaded interior end attaching the minor cylinder to the side wall. A coil spring 150 urges the pivot block away from the nut.

The activating/inactivating assembly 128 includes a major cylinder 154 with an extended interior section terminating adjacent to the pivot block. The major cylinder has a free section 156. The major cylinder has an intermediate section with a cam surface 158 with a projection 160 exterior of the chamber. The major cylinder includes a handle 164 for rotating the major cylinder in a first direction with the projection outside of the recess and the throw off component moving to an inoperative orientation. The handle is also for rotating the major cylinder in a second direction with the projection within the recess and the throw off component moving to an operative orientation.

Lastly provided, an adjustable tensioning assembly 168 includes a shaft 170 with a threaded end 172 and a knurled head 174. The shaft extends through the major cylinder and the minor cylinder and the coil spring and is threadedly coupled to the central section of the pivot block. Rotating the knurled head in a first direction will adjustably loosen the throw off component and vary the tone. Rotating the knurled head in a second direction will adjustably loosen the throw off component and vary the tone.

While the invention herein disclosed has been described by means of specific embodiments and applications thereof, numerous modifications and variations could be made thereto by those skilled in the art without departing from the scope of the invention set forth in the following claims.

What is claimed is:

1. A snare drum throw off comprising:

a pivot block pivotally attachable to a side wall of a drum for rotation about a first axis between an engaged position and a disengaged position, the pivot block having an upper extent configured for attachment to a snare;

a minor cylinder having opposed first and second ends, a first longitudinal bore extending entirely through the minor cylinder between the first and second ends thereof, and a first cam surface;

a major cylinder having opposed first and second ends, a second longitudinal bore extending entirely through the major cylinder between the first and second ends thereof, and a second cam surface, a length of the major cylinder is disposed within the first longitudinal bore with the first and second cam surfaces in contact with each other, and such that the major cylinder is rotatable about a second axis with respect to the minor cylinder between a first rotation position and a second rotation position and such that major cylinder can reciprocate with respect to the minor cylinder along the second axis between a first slide position and a second slide position;

wherein in the first rotation position the contact between the first and second cam surfaces positions the major cylinder in the first slide position, and in the second rotation position the contact between the first and second cam surfaces positions the major cylinder in the second slide position;

a tension bolt having first and second ends, the tension bolt extending through the second axial bore with the first end thereof threadedly attached to the pivot block, the second end of the tension bolt having a head engaged against the second end of the major cylinder;

a spring held captive between the pivot block and the minor cylinder and biasing the pivot block in a direction away from the minor cylinder and into the disengaged position; and wherein when the major cylinder is disposed in the first slide position, the pivot block is disposed in the disengaged position, and when the major cylinder is disposed in the second slide position, the pivot block is disposed in the engaged position.

2. The snare drum throw off of claim 1, wherein the first cam surface has a recess stop and the second cam surface as a stop projection that engages with the recess stop when the major cylinder is in the second rotation position to prevent over rotation of the major cylinder.

3. The snare drum throw off of claim 1, wherein tightening and loosening the tension bolt adjusts the engaged position of the pivot block about the first axis.

4. The snare drum throw off of claim 1, wherein the major cylinder has a handle at its first end.

5. The snare drum throw off of claim 1, wherein the head of the tension bolt is knurled.

6. The snare drum throw off of claim 1, wherein the first axis and second axis are generally perpendicular to one another.

* * * * *